US005478504A

United States Patent [19]

de Almeida Barbuto

[11] Patent Number: 5,478,504

[45] Date of Patent: Dec. 26, 1995

[54] METHOD AND APPARATUS FOR ELIMINATING SEVERE SLUG IN MULTI-PHASE FLOW SUBSEA LINES

[75] Inventor: Fausto A. de Almeida Barbuto, Higienópolis, Brazil

[73] Assignee: Petroleo Brasileiro S.A. - Petrobras, Rio de Janeiro, Brazil

[21] Appl. No.: 312,656

[22] Filed: Sep. 27, 1994

[30] Foreign Application Priority Data

Sep. 27, 1993 [BR] Brazil ..... 9303910-7

[51] Int. Cl.[6] ..... B01F 3/04

[52] U.S. Cl. ..... 261/19; 261/64.3; 137/110

[58] Field of Search ..... 261/19, 64.3, DIG. 75; 137/110

[56] References Cited

U.S. PATENT DOCUMENTS

| | | | |
|---|---|---|---|
| 3,273,576 | 9/1966 | Fluegel et al. | 137/110 |
| 3,486,555 | 12/1969 | Vincent . | |
| 3,689,237 | 9/1972 | Stark et al. | 137/110 |
| 4,058,137 | 11/1977 | de Saint Palais et al. . | |
| 4,310,335 | 1/1982 | Arnaudeau | 261/19 |
| 4,332,509 | 6/1992 | Reynard et al. . | |
| 4,732,712 | 3/1988 | Burnham et al. | 261/64.3 |
| 4,781,208 | 11/1988 | Zettier | 137/110 |
| 5,035,842 | 7/1991 | Mohn | 261/DIG. 75 |
| 5,127,272 | 7/1992 | Dean et al. . | |
| 5,135,684 | 8/1992 | Mohn | 261/DIG. 75 |
| 5,254,292 | 10/1993 | Gabryelczyk et al. | 261/DIG. 75 |
| 5,377,714 | 1/1995 | Giannesini et al. | 137/110 |

FOREIGN PATENT DOCUMENTS 0331295 9/1989 European Pat. Off. .

*Primary Examiner*—Tim R. Miles

*Attorney, Agent, or Firm*—Sughrue, Mion, Zinn, Macpeak & Seas

[57] ABSTRACT

This invention refers to a method for the control of the phenomenon of severe slug in multi-phase flow subsea lines such as those for conveying petroleum from a subsea wellhead to the surface, comprising the installation of at least one secondary line (3), a secondary riser that starts at the downward geometry production line (1) and finishes in the vertical line (2) that conveys the fluids to the production unit, the said secondary line (3) collecting the gas segregated at the top of downward geometry production line (1) at a point B located at a distance "L" from the joint C between the production line (1) and the vertical line (2), and transports the gas to a point A located in the vertical line (2) and a distance "H" from the aforesaid joint C, the pressure differential existing between points A and B ensuring gas flow between said points, with possibilities of installing a control valve (4) in the secondary auxiliary line (3) so as to control the gas flow, the operation of said control valve being monitored by a primary control device (5) that gauges some physical magnitude that is significant for the control of severe slug, such as pressure or density, and that acts on the control valve so as to ensure a stable flow of gas.

13 Claims, 3 Drawing Sheets

METHOD AND APPARATUS FOR ELIMINATING SEVERE SLUG IN MULTI-PHASE FLOW SUBSEA LINES

FIELD OF THE INVENTION

This invention is intended to avoid the harmful effects that the phenomenon called severe slug causes in activities involving the flow of multi-phase fluids, such as in subsea oil production.

BACKGROUND OF THE INVENTION

This invention refers to a method for eliminating severe slug, a phenomenon occurring in riser production line unit type multi-phase flow lines, by the inclusion of auxiliary lines or groups of lines that may or may not be provided with flow control means.

PRIOR ART

The phenomenon of severe slug is characterized by considerable oscillations in the levels of pressure and flowrate in a multi-phase flow operation, marked by the presence of gases. Severe slug, particularly in activities of subsea oil production, causes harmful effects, that may seriously jeopardize production.

In the commercial operation of a subsea oil field, extracted oil must be caused to flow through pipelines from the wellheads to the production unit located at the surface. The production lines coming from the wellheads located on the sea floor are connected up at a particular point to vertical lines referred to by the experts as risers, which carry the extracted fluids up to the surface.

Severe slug occurs when two conditions are present, namely: stratified downward flow in the production line and the occurrence of pressure in the production line exceeding that existing in the riser. The slope of the production line and the speed acquired under particular conditions by multi-phase oil/gas flow give rise to conditions wherein the flow in the production line becomes stratified, thus allowing a liquid seal to be formed that favors gas segregation in the production line upper part. This gas segregation in the upper part of the production line is a conditioning factor for the phenomenon of severe slug to occur.

As a result of its substantially transient characteristics, severe slug causes considerable, oscillation in pressure levels and in the flow of the fluids produced, and may in extreme cases lead to stoppage of production.

In order to eliminate the harmful effects that severe slug causes to subsea oil production, a number of solutions have been proposed. In practically all cases, however, they result in curtailment of production, which is not always desirable.

Practically all methods adopted in the prior art entail the use of pressure vessels installed in the production unit, wherein the multi-phase oil/gas flow is subject to a process of separation. As, however, these separators are normally designed to operate under the most severe conditions, their cost is quite high. They also present the disadvantage of requiring considerable room for their installation and are extremely heavy, which goes to render the undertaking even more expensive.

European patent application EP 331 295 describes a method of subsea separation of a multi-phase flow in which a secondary riser is connected with the production line by a trunk joint installed at a given point, upstream of the point at which the connection between the production line and the main riser is effected. The main riser is connected to a pressure vessel located in the production unit, termed a surge vessel, and the secondary riser is connected to a pressure vessel, also located in the production unit and intended to provide for removal of the liquid swept along by the gas flow (the "GAS SCRUBBER"). A flow-regulating valve is installed in the secondary riser, close to the intake point of the GAS SCRUBBER.

A series of capacitative detectors are installed in the production line, in the portion between the secondary and main risers. These detectors are intended to detect the presence of the oil/gas interface in the production line and emit signals to a control unit, that is responsible for the operation of the control valve.

The oil and gas flowing along the production line are separated at the trunk joint with the secondary riser. The stream of gas proceeds along the secondary riser and that of oil continues to flow along the production line and via the main riser. The control valve opens so as to relieve the pressure of gas in the secondary riser whenever the detectors detect an oil/gas interface in the production line.

This method is efficient in preventing the effects of severe slug. It displays certain disadvantages, however, such as the need for adopting an expensive GAS SCRUBBER that requires quite some room for installation, as well as the need for using a second stretch of riser from tire sea floor up to the production unit, the components of which make the investment higher in two ways, due to both their inherent costs and to the increased load to be supported by the production unit. Another serious disadvantage of this method is that the riser cuts back the pressure in the production line, with consequent curtailment of the flow rate, that is, a reduction in the volume of crude extracted.

The invention does away with the need for extending the secondary riser up to the production unit at the surface, dispenses with the adoption of the GAS SCRUBBER, and does not have the disadvantage of lowering production line pressure, with consequent reduction in the volume of production.

SUMMARY OF THE INVENTION

One aspect of the present invention provides a method of eliminating severe slug in subsea multi-phase lines, such as those for conveying petroleum from a subsea wellhead to the surface, wherein at least one secondary line is provided, that starts at a first point in the downward geometry production line, spaced from the joint between the production line and the vertical line that conveys the fluids to the production unit, and ends at a point located in the vertical line spaced from the joint between the downward geometry production line and the vertical line, wherein said secondary line is intended to collect the gas at the top of said downward geometry production line and to transport it to the vertical line.

A further aspect of this invention provides a subsea multi-phase line system connecting a subsea well head to the surface, comprising a downward geometry production line, a vertical line connected to the downstream end of said downward geometry production line and able to convey production flow towards the surface, and at least one secondary line extending from the top of the downward geometry production line at a point spaced from the junction between said downward geometry production line and said vertical line and communicating with said vertical line at a point spaced above the said connection between the downward geometry production line and the vertical line.

The gas separated out in the upper part of the downward geometry production line is collected by the auxiliary secondary riser, said secondary riser having one end connected up to the production line at a given point at a distance "L" from the point of attachment of the production line to the main riser and the other end connected to the main riser at a distance "H" from the point of attachment of the production line to the main riser. Conveyance of the gas via the secondary riser between the points of intersection between the secondary riser and the top of the production line and of intersection with the main riser is ensured by the pressure differential existing between the two points in question.

BRIEF DESCRIPTION OF THE DRAWINGS

The invention will be more readily perceived from the following detailed description given with reference to the accompanying drawings, in which.

DETAILED DESCRIPTION

Figure 1:
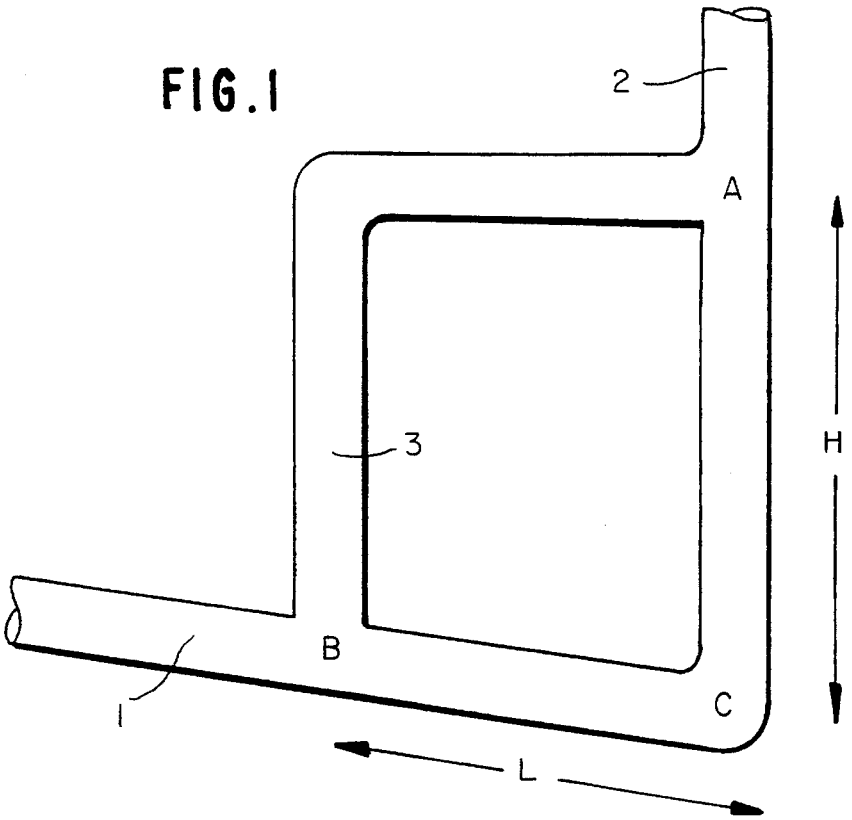
FIG. 1 is a schematic view of the downward geometry production line connected to the main riser and of an auxiliary secondary riser that is the object of the method embodied in this invention.

As may be seen from FIG. 1, the method of elimination of severe slug in production line/riser unit type multi-phase flow lines located in subsea environments comprises the provision of a secondary auxiliary line 3, called the secondary riser, which emerges from the downward geometry production line 1, and ends in the vertical line 2 called the main riser, which is the piping that conducts the fluids up to the production unit for treatment and separation (not shown in the FIG.).

If the phenomenon of severe slug occurs, the gas segregated at the top of production line 1 is collected at the point of intersection B between the secondary riser 3 and production line 1, at a distance "L" from the joint C between production line 1 and the main riser 2, and hoisted to the main riser 2 at point A, the intersection between secondary riser 3 and main riser 2. The latter point A is located at a height "H" in relation to the point of attachment C between the production line i and the main riser 2.

Figure 2:
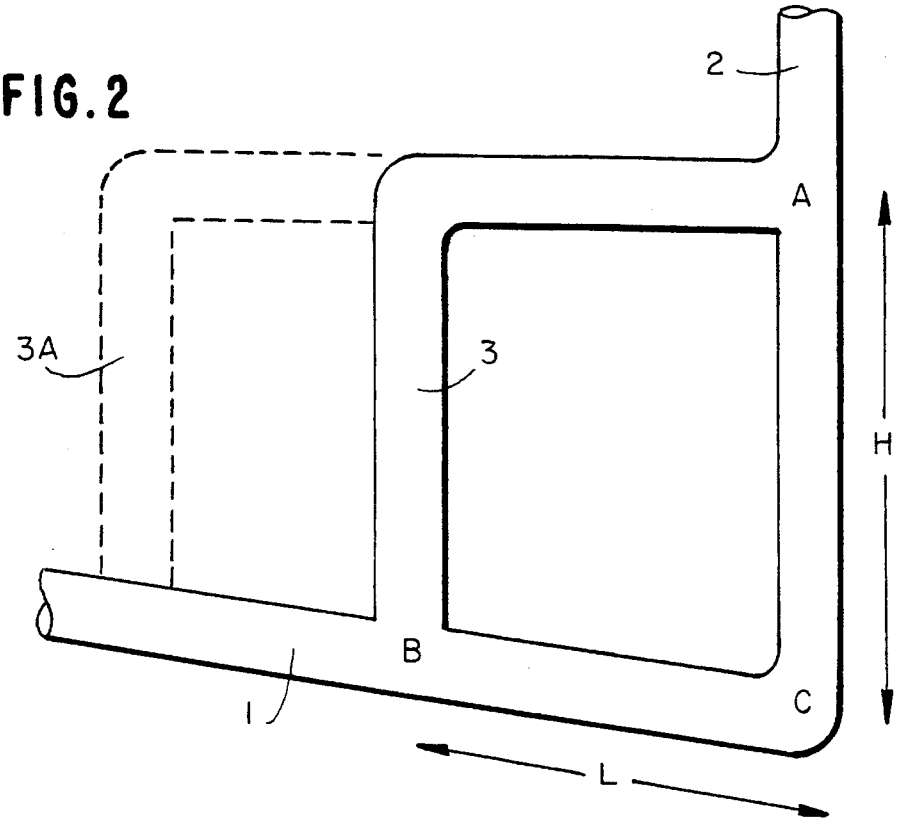
FIG. 2 is a schematic view of the downward geometry production line connected to the main riser and of two secondary auxiliary risers, in accordance with a variation in the method of this invention.

Conveyance of the gas from point B of intersection between the secondary riser 3 and production line 1, and point A of intersection between the secondary riser and the main riser 2 is ensured due to the pressure differential between the aforesaid points B and A. The gas segregated in the upper part of production line 1 may be collected at a number of different points. In FIG. 2, purely for illustrative purposes, a second auxiliary riser 3A is shown, but it should be understood that other secondary risers too may be included in the set-up.

Figure 3:
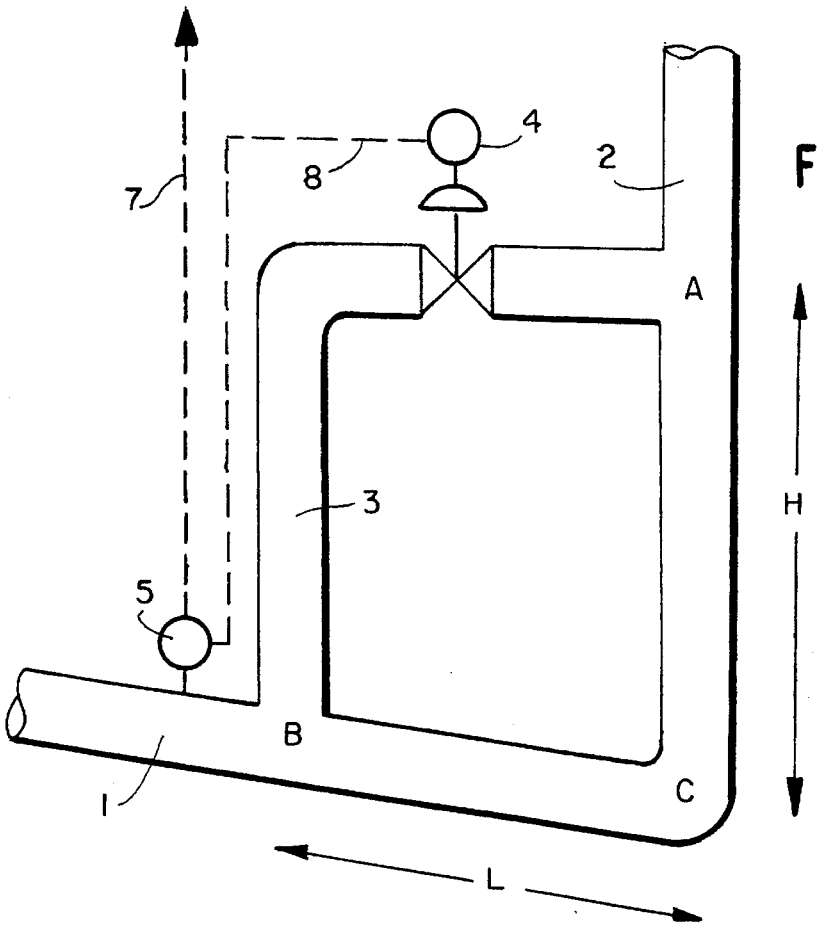
FIG. 3 is a schematic view of the downward geometry production line connected to the main riser and of an auxiliary secondary riser with automatic control by means of instrumentation for the pressure at the point of attachment of the production line to the auxiliary riser.
Figure 4:
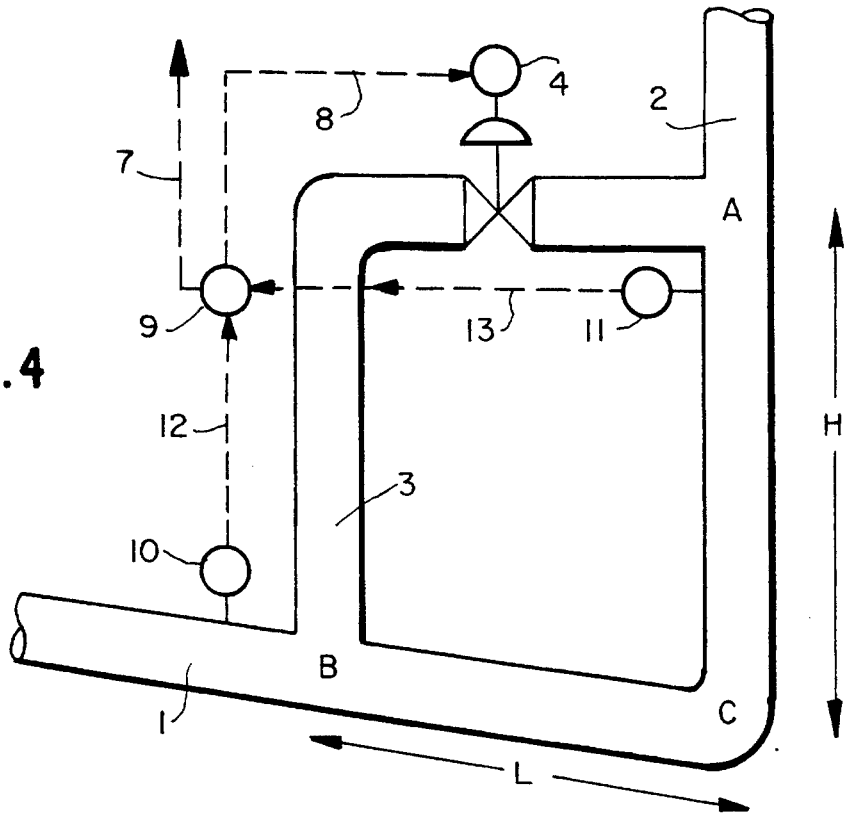
FIG. 4 is a schematic view of the downward geometry production line connected to the main riser and of a secondary auxiliary riser with automatic instrumented control over the differential pressure existing between the joint between the production line and the auxiliary riser and the joint between the main and auxiliary risers.
Figure 5:
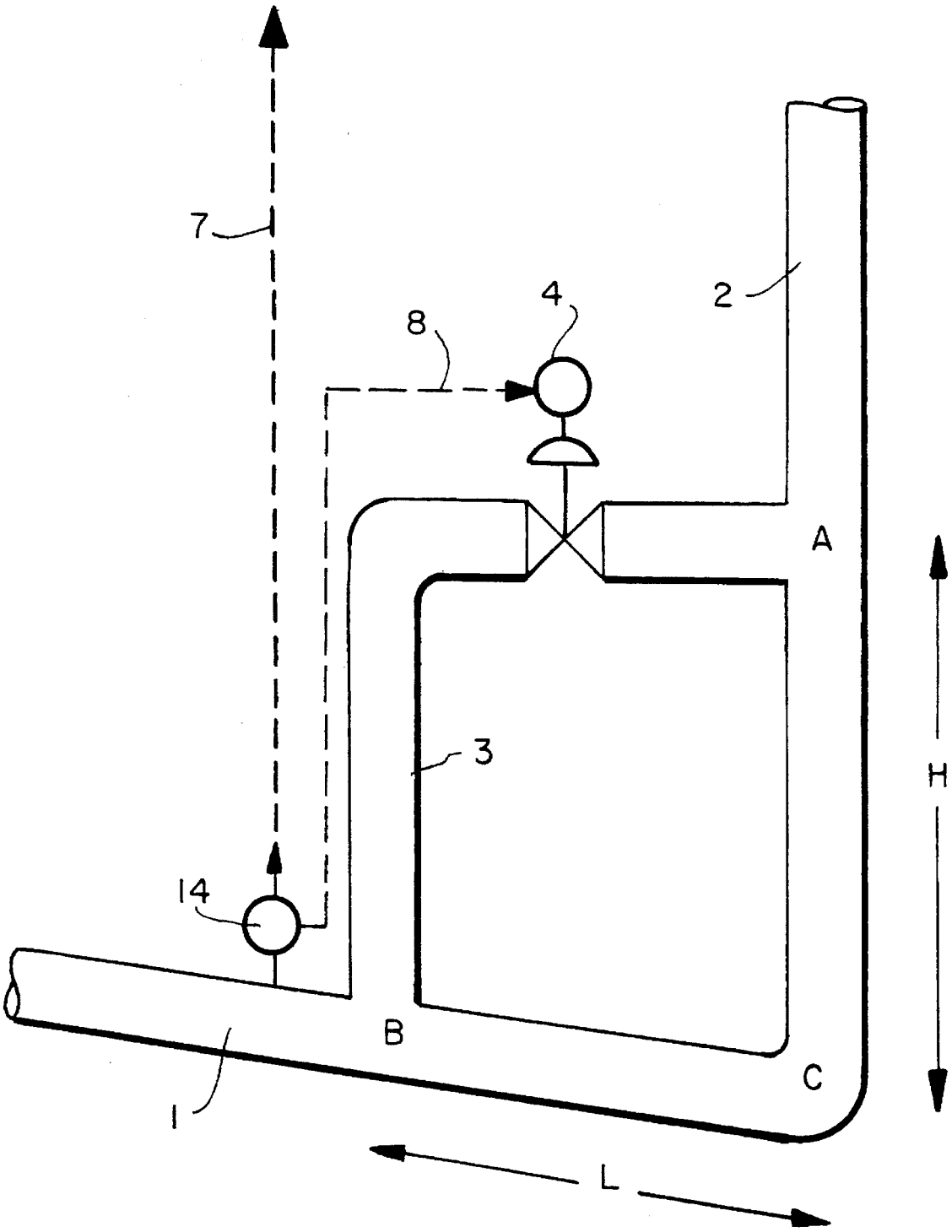
FIG. 5 is a schematic view of the downward geometry production line connected to the main riser and of an auxiliary secondary riser with automatic instrumented control of the density of the fluid flowing in the joint between the production line and the auxiliary riser.

A second embodiment of the method provided by this invention may be seen in FIGS. 3 to 5. In that embodiment the flow of gas conveyed via the auxiliary riser 3 is controlled by a control valve 4. A primary control device, 5, 9 or 14, is responsible for controlling the modus operandi of control valve 4. The primary control unit 5, 9 or 14, is used to measure on the stream any physical magnitude significant for evaluation of the phenomenon of severe slug, such as pressure or density, and acts on control valve 4 so as to open or close it and thus permit the flow of the gas segregated at the top of production line 1 at point B to point A in main riser 2.

A first alternative of this embodiment is shown in FIG. 3, in which the primary control element 5 is a pressure gauge and control unit (PIC) installed at a point upstream from point B of intersection between the secondary riser 3 and the production line 1. Said primary control device 5 emits a signal to control valve 4 via line B. The signal may be hydraulic, pneumatic or electrical, though not being limited to these modalities alone. Electro-electronic lines 7, or any other data transmission device, transmit data from the primary control element 5 to a control panel located in the surface production unit (not shown in the FIG.) so as to enable monitoring of the process of opening and closing control valve 4, and, whenever necessary, altering the points of adjustment of the primary control unit 5 so as to operate the aforesaid control valve 4.

When the pressure at the point of intersection B of production line 1 and secondary riser 3 reaches a level lower than that set in the primary control device 5, a signal is transmitted to control valve 4, so that the latter progressively closes, reducing the flow of gas between points B and A to the point where the pressure at control point B stabilizes at the desired level. The opposite effect occurs if the pressure level at control point B is higher than had been set previously, meaning that control valve 4 will then progressively open, thus increasing the flow of gas between points B and A. This allows control to be maintained over the volume of gas segregated at the top of production line 1, and the effects of severe slug are eliminated or minimized.

The flow between points B and A may be interrupted, if so desired, and all that needs to be done in that case is for the set point of the primary control device 5 to be located at a very low pressure level or for the control system to be placed in a by-pass mode. If the set point of primary control device 5 is established at a very high level, control valve 4 will remain permanently open.

A second alternative of the second embodiment of the method embodied in this invention can be seen in FIG. 4. In this alternative, as in the previous one, the flow of gas in secondary riser 3 is also controlled by a control valve 4. A primary control device 9, called the differential pressure indicator and controller (DPIC), is responsible for controlling the operation of control valve 4. The aforesaid primary control device 9 receives data from two pressure transducers (PT) 10 and 11, via lines 12 and 13 respectively, the transducers being installed upstream of points B and A.

The primary control device 9 detects the pressure differential between points B and A, and emits a signal to control valve 4 via line B, so that the control valve 4, opening or closing progressively, maintains the pressure differential between control points B and A at a previously set constant level. The signal emitted by control unit 9 may be either hydraulic, pneumatic or electrical, without being necessarily limited to these three modes.

Electro-electronic lines 7, or any other data transmission system, convey data from the primary control unit 9 to a control panel located in the production unit at the surface (not shown in the illustration), so as to enable follow-up of the process of opening and closing the control valve and also, whenever necessary, altering the set points for the operation of the aforesaid control valve 4.

A third alternative for the second embodiment of this invention appears in FIG. 5. In that alternative, as in the two previous ones, the flow of gas conveyed via auxiliary riser 3 is also controlled by a control valve 4. A primary control device 14, which is a density monitoring device called a densitometer (DT), is installed at a point upstream from point B of intersection between the secondary riser 3 and production line 1. Primary control device 14 is responsible for controlling the operation of the control valve. The aforesaid primary control device 14 emits a signal to control valve 4 via line B, which may be hydraulic, pneumatic or electrical, without being necessarily limited to these three modes.

Primary control device 14 detects the presence of gas segregated at the top of production line 1 at point B and emits a signal to control valve 4 via line 8, so that said control valve 4 opens completely, allowing the gas to flow between points B and A. The opposite effect occurs when primary control device 14 ceases to detect the presence of gas segregated at the top of production line 1 at point B. This means that control valve 4 closes.

Electro-electronic lines 7, or any other means of data transmission, convey data from the primary control device to a control panel located in the production unit at the surface (not shown in the FIG.), so as to permit monitoring of the process of opening and closing of the control valve 4 and, whenever necessary, altering the set points of the primary control device 14 for the operation of the aforesaid control valve 4.

It is important to emphasize once again that any physical magnitude that can be measured and evaluated by a primary control unit and that is significant for evaluating the effects of severe slug may be used alternatively as a parameter for controlling flow. In that case the remaining components would be basically the same.

In all drawings shown in FIGS. 1 to 5, points B and A are located within production line 1 and main riser 2 respectively, whereas height "H" from point of attachment C to point D should preferably be about ⅓ (one third) the total height of riser 2. Distance "L" from point B to joint C should preferably be equal to height "H".

It is advisable that the diameter of secondary riser 3 for collecting gas not be less than 75% of the diameter of the production line 1-main riser 2 unit, so as to ensure stable flow of gas via auxiliary riser 3. The modifications proposed in FIGS. 1 to 5 are minor and inexpensive when compared with the benefits that can be derived therefrom. The components of the instrumentation system to be included are widely known and employed in the petroleum, chemical and petrochemicals industries.

It should also be stressed that the method provided by this invention, in all its embodiment, affords considerable advantages in relation to those currently employed, in that it does not cut down on the, volume of oil produced, and the contrary effect may even occur, inasmuch as the fluidification provided by the gas injected at point A of main riser 2 affords the effect of relieving the column weight above this point A, in a manner somewhat resembling the effect obtained by the method of pneumatic pumping (gas lift) for recovery of petroleum from a well. The method proposed in this invention may provide an oil production effect that is larger, more stable and of constant value.

I claim:

1. A method of eliminating severe slug in subsea multiphase lines for conveying petroleum from a subsea wellhead to the surface, wherein at least one secondary line (3) is provided that starts at a first point in the downward geometry production line (1), spaced from the joint between the production line (1) and the vertical line (2) that conveys the fluids to the production unit, and ends at a point located in the vertical line (2) spaced from the joint between the downward geometry production line (1) and vertical line (2), wherein said secondary line (3) is intended to collect the gas at the top of said downward geometry production line (1) and to transport it to vertical line (2).

2. A method according to claim 1, wherein the flow of said gas is controlled by a control valve (4) in said secondary line (3), and wherein the operating mode of said control valve (4) is controlled by a primary control device (5), (9), (14).

3. A method according to claim 2, wherein said primary control device (5) is of the pressure control and indicator type.

4. A method according to claim 2, wherein said primary control device (9) is of the differential pressure control and indicator type.

5. A method, according to claim 2, wherein said primary control device (14) is of the density measuring type.

6. A method according to claim 1 wherein the distance measured from the intersection of said secondary line (3) and the downward geometry production line (1) to the joint between said vertical line (2) and said downward geometry production line is at least ⅓ of the total height of said vertical line (2).

7. A method, according to claim 6, wherein the distance from the intersection between said downward geometry production line (1) and said secondary line (3) to the joint between said downward geometry production line (1) and said vertical line (2) conveying the fluids to the production unit is approximately equal to the distance from the intersection of secondary line (3) and said downward geometry production line (1) to the joint between said vertical line (2) and said downward geometry production line (1).

8. A method according to claim 7, wherein the diameter of the said secondary line (3) at least 75% (seventy-five per cent) of the diameter of the production line (1) and vertical line (2).

9. A subsea multi-phase line system connecting a subsea well head to the surface, comprising a downward geometry production line (1), a vertical line (2) connected to the downstream end of said downward geometry production line (1) and able to convey production flow towards the surface, and at least one secondary line (3) extending from the top of the downward geometry production line (1) at a point spaced from the junction between said downward geometry production line (1) and said vertical line (2) and communicating with said vertical line at a point spaced above the said connection between the downward geometry production line (1) and the vertical line (2).

10. A system according to claim 9, and including a control valve (4) in said secondary line (3), controlled by a primary control device (5), (9), (14).

11. A system according to claim 10, wherein said primary control device (5) is a pressure control and indicator type of control device.

12. A system according to claim 11, wherein said pressure control device (9) is a differential pressure control device.

13. A system according to claim 10, wherein said primary control device (14) is of the density measuring type.

* * * * *